US008384281B2

(12) United States Patent
Yamamoto et al.

(10) Patent No.: US 8,384,281 B2
(45) Date of Patent: Feb. 26, 2013

(54) MATRIX-TYPE COLD-CATHODE ELECTRON SOURCE DEVICE

(75) Inventors: Makoto Yamamoto, Hyogo (JP); Keisuke Koga, Ehime (JP)

(73) Assignee: Panasonic Corporation, Osaka (JP)

( * ) Notice: Subject to any disclaimer, the term of this patent is extended or adjusted under 35 U.S.C. 154(b) by 82 days.

(21) Appl. No.: 12/991,005

(22) PCT Filed: Apr. 27, 2009

(86) PCT No.: PCT/JP2009/001911

§ 371 (c)(1),
(2), (4) Date: Nov. 4, 2010

(87) PCT Pub. No.: WO2009/139122

PCT Pub. Date: Nov. 19, 2009

(65) Prior Publication Data

US 2011/0057555 A1 Mar. 10, 2011

(30) Foreign Application Priority Data

May 12, 2008 (JP) ..... 2008-124316

(51) Int. Cl.
*H01J 1/30* (2006.01)
*H01J 1/304* (2006.01)
*H01J 1/46* (2006.01)

(52) U.S. Cl. ..... 313/495; 313/497; 313/311

(58) Field of Classification Search ..... 313/495–497, 313/309–311; 315/169.1–169.2
See application file for complete search history.

(56) References Cited

U.S. PATENT DOCUMENTS

| | | | | | |
|---|---|---|---|---|---|
| 5,578,896 | A * | 11/1996 | Huang | 313/309 |
| 5,633,561 | A * | 5/1997 | Barker | 313/497 |
| 5,666,020 | A | 9/1997 | Takemura | |
| 5,717,279 | A * | 2/1998 | Imura | 313/336 |
| 5,726,530 | A * | 3/1998 | Peng | 313/495 |
| 6,034,480 | A * | 3/2000 | Browning et al. | 315/169.1 |
| 6,163,107 | A * | 12/2000 | Itoh et al. | 313/495 |
| 6,414,421 | B1 | 7/2002 | Imura et al. | |
| 6,583,477 | B1 * | 6/2003 | Hwang et al. | 257/360 |
| 2003/0122197 | A1 | 7/2003 | Hwang et al. | |
| 2005/0040752 | A1 * | 2/2005 | Lee et al. | 313/495 |
| 2005/0236964 | A1 * | 10/2005 | Kamide et al. | 313/495 |
| 2006/0006788 | A1 * | 1/2006 | Lee et al. | 313/495 |
| 2006/0066198 | A1 | 3/2006 | Yamamoto et al. | |

FOREIGN PATENT DOCUMENTS

| | | | |
|---|---|---|---|
| JP | 07130306 | A * | 5/1995 |
| JP | 08-031305 | | 2/1996 |
| JP | 08-138530 | | 5/1996 |
| JP | 11-102637 | | 4/1999 |
| JP | 2000-149762 | | 5/2000 |
| JP | 2000-215793 | | 8/2000 |
| JP | 2001-236877 | | 8/2001 |

(Continued)

*Primary Examiner* — Mariceli Santiago
(74) *Attorney, Agent, or Firm* — Hamre, Schumann, Mueller & Larson, P.C.

(57) ABSTRACT

A matrix-type cold-cathode electron source device includes: an emitter array (3*b*) in which a plurality of emitters are arranged, and a gate electrode (5) opposed to the emitter array (3*b*). The gate electrode (5) includes: an emitter area gate electrode (5*c*) opposed to the emitter array (3*b*); a gate address electrode (5*a*) connecting the emitter area gate electrode (5*c*) to a gate signal wire (8*a*); and a high-resistance area (5*b*) disposed between the gate address electrode (5*a*) and the emitter area gate electrode (5*c*).

5 Claims, 3 Drawing Sheets

FOREIGN PATENT DOCUMENTS

| | | |
|---|---|---|
| JP | 2002-299264 | 10/2002 |
| JP | 2003-203555 | 7/2003 |
| JP | 2004-241292 | 8/2004 |
| JP | 2006-120624 | 5/2006 |

* cited by examiner

MATRIX-TYPE COLD-CATHODE ELECTRON SOURCE DEVICE

TECHNICAL FIELD

The present invention relates to a matrix-type electron source device using a cold-cathode electron source element, and particularly relates to the configuration of a cold-cathode electron source element for preventing a line defect during a matrix operation.

BACKGROUND ART

A high melting metal such as tungsten and molybdenum is formed into projections and an electric field is applied to the ends of the projections in a vacuum from the outside, so that electrons induced to the ends of the metal are emitted to the outside. Generally, the metal projections are called emitters and the emission of electrons from the emitters is called field emission or field radiation.

Elements for emitting electrons to the outside through the field emission are called field-emission electron source elements or cold-cathode electron source elements and have been recently used in various fields. For example, the elements are used as the electron sources of electron microscopes instead of hot filaments of the related art, and are used for fluorescent display tubes in which light is emitted from phosphors by drawing electrons to an anode electrode on which phosphor films are formed so as to be opposed to electron source elements.

Generally, emitters have small structures and a single emitter cannot obtain a sufficient amount of current. Thus a group of emitters is used to obtain a sufficient amount of current. In the present specification, a group of emitters is called "cold-cathode electron source elements".

Further, field emission displays (FEDs) have become practical in which cold-cathode electron source elements are arranged in a matrix to constitute a cold-cathode electron source array, an anode electrode on which phosphors corresponding to red, green, and blue are formed is disposed on the opposed side, and electrons through field emission are drawn to the anode electrode so as to emit light from the phosphors. The following will describe, as an example, an FED using Spindt-type emitters shown in FIG. 3.

The FED is configured such that a cathode substrate 101 and an anode substrate 111 are opposed to each other. On the surface of the cathode substrate 101, strip emitter address signal wires 102*a* are formed in parallel and a gate insulating film 103 is formed over the emitter address signal wires 102*a*. On the surface of the gate insulating film 103, strip gate signal wires 104*a* are formed so as to cross the emitter address signal wires 102*a*.

On the gate signal wires 104*a* and the gate insulating film 103, a plurality of openings are formed in an area where the gate signal wires 104*a* and the gate insulating film 103 cross the emitter address signal wires 102*a*. In the respective openings, emitters 102*b* are formed so as to be disposed on the emitter address signal wires 102*a*. At this point, the openings on the surfaces of the gate signal wires 104*a* act as gate electrodes 104*b*. An electric field is applied to the gate electrodes 104*b* through the gate signal wires 104*a*, so that electrons can be emitted from the ends of the emitters 104*b*. An area where the emitters 104*b* and the gate electrodes 104*b* are formed is called a cold-cathode electron source element area.

Over a surface of the anode substrate 111, an anode electrode (not shown) of a transparent conductive film is formed such that the anode electrode faces the cathode substrate 101.

On the anode electrode, phosphors 113R, 113G, and 113B of red, green, and blue are sequentially formed in strips. The phosphors are formed in parallel with the gate signal wires formed on the cathode substrate 101.

Electron emission from the electron source elements arranged in a matrix is sequentially controlled by a video circuit, achieving video display elements that display a desired image with light emitted from the phosphors. The light is emitted by the electrons received on the anode electrode having been fed with a voltage.

In the same configuration, by forming a photoelectric conversion film on the surface of the anode electrode, the electron source elements can be also used as image elements for reading hole-electron pairs, which have been induced by external light, by electrons emitted from the electron source elements.

In recent years, FEDs and image elements have had higher resolutions and a larger number of pixels have been demanded. As in LCDs (Liquid Crystal Displays) and PDPs (Plasma Display Panels), FEDs have been severely inspected for defects. Products with line defects appearing like lines are not valuable at all, and thus it is necessary to reduce the defects to at least point defects that appear within pixels.

Generally, electron source elements arranged in a matrix have a so-called simple matrix configuration in which pixels are connected to two intersecting signal wires and the electron source elements are operated by generating a predetermined potential at the intersections of the signal wires.

In the simple matrix configuration of the related art, however, a short circuit at the intersection between the wires may prevent the passage of the predetermined potential over the wires, so that all of the pixels connected to the wires may become inoperable and cause line defects. As a solution to the line defects, an excessive current flowing into a short-circuit point is limited to suppress a voltage drop on the signal wires. The following are known techniques of suppressing excessive current to gate electrodes or emitters in electron source elements (e.g., see patent documents 1 to 4).

CITATION LIST

Patent Documents

Patent document 1: Japanese Patent Laid-Open No. 2000-149762

Patent document 2: Japanese Patent Laid-Open No. 08-031305

Patent document 3: Japanese Patent Laid-Open No. 2000-215793

Patent document 4: Japanese Patent Laid-Open No. 08-138530

DISCLOSURE OF THE INVENTION

Problem to be Solved by the Invention

In the configuration of the related art, however, the number of pixels increases as FEDs and image elements have higher resolutions. Thus it is necessary to increase the number of emitters. However, as the number of emitters increases, a potential gradient between the signal wire and the emitter becomes more uneven and variations in electron emission efficiency among the emitters increase. Because of the uneven potential gradient between the signal wire and the emitter and variations in electron emission efficiency among the emitters, a current concentrates only on specific one of the emitters. Consequently, the emitters may deteriorate, a break may occur, and a short circuit may occur between the gate and the emitter, resulting in the line defect.

The present invention has been devised to solve the problem of the related art. An object of the present invention is to provide a matrix-type cold-cathode electron source device which can prevent a line defect during a matrix operation even when the number of emitters is increased.

Means for Solving the Problem

A matrix-type cold-cathode electron source device of the present invention includes: an emitter array that is formed on an emitter address electrode and contains a plurality of emitters for emitting electrons; and a gate electrode opposed to the emitter array, wherein the gate electrode includes: an emitter area gate electrode opposed to the emitter array; a gate address electrode connecting the emitter area gate electrode to a gate signal wire; and a high-resistance area disposed between the gate address electrode and the emitter area gate electrode.

A matrix-type cold-cathode electron source device of the present invention includes: an emitter array that is formed on an emitter address electrode and contains a plurality of emitters for emitting electrons; and a gate electrode opposed to the emitter array, wherein the gate electrode includes: an emitter area gate electrode opposed to the emitter array; a gate address electrode connecting the emitter area gate electrode to a gate signal wire; and a high-resistance area disposed between the gate address electrode and the emitter area gate electrode, and the matrix-type cold-cathode electron source device further includes a shield electrode on the gate electrode via an insulating layer, the shield electrode being connected to the emitter area gate electrode.

Preferably, the shield electrode is disposed over the high-resistance area. Further, the shield electrode is made of the same material as the gate electrode.

Moreover, an area other than the high-resistance area of the gate electrode includes a polysilicon film containing a high concentration of N-type impurity, and the high-resistance area includes one of a polysilicon film containing no impurities and a polysilicon film containing a low concentration of impurity. Specifically, the high-resistance area has a resistance value of 50 kΩ to 10 MΩ.

ADVANTAGE OF THE INVENTION

According to a matrix-type cold-cathode electron source device of the present invention, it is possible to reliably prevent a line defect caused by a short circuit between a gate electrode and an emitter.

BEST MODE FOR CARRYING OUT THE INVENTION

The following will specifically describe embodiments of a matrix-type cold-cathode electron source device of the present invention in accordance with the accompanying drawings.

(First Embodiment)

Figure 1A:
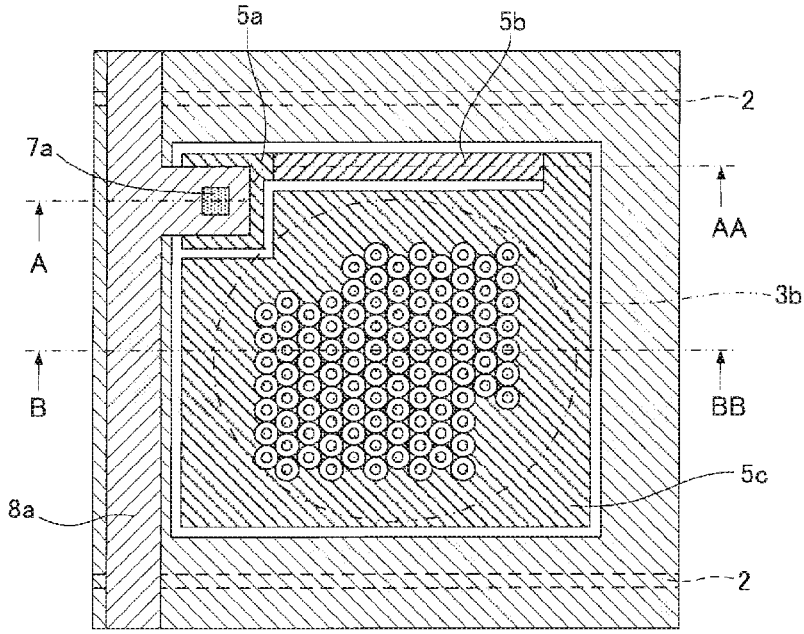
FIG. 1A is a plan view showing the configuration of a cold-cathode electron source element according to a first embodiment of the present invention.
Figure 1B:
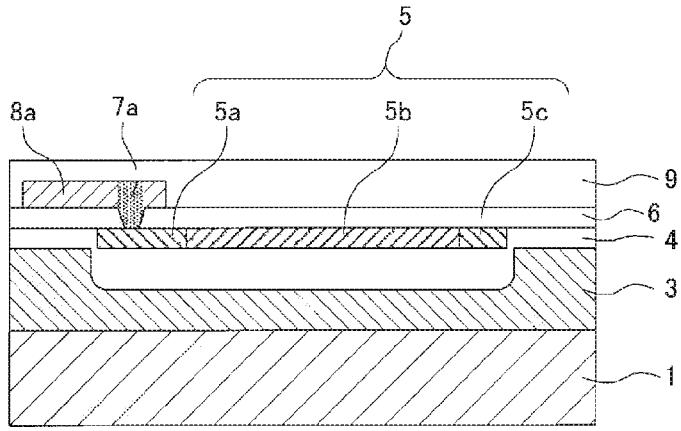
FIG. 1B is a schematic diagram showing a cross section taken along line A-AA according to the first embodiment.
Figure 1C:
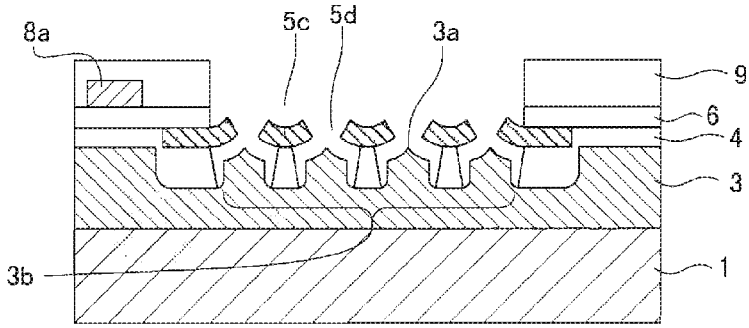
FIG. 1C is a schematic diagram showing a cross section taken along line B-BB according to the first embodiment.

FIGS. 1A, 1B, and 1C are a plan view and cross-sectional schematic views showing the configuration of a cold-cathode electron source element that is a unit constituting a cold-cathode electron source device according to a first embodiment of the present invention. In the present embodiment, the cold-cathode electron source element is formed on a substrate 1 that is a monocrystalline P-type silicon substrate. At the center of the substrate 1, an emitter address electrode 3 is formed and element isolating areas 2 are formed on both sides of the emitter address electrode 3. In the present embodiment, the element isolating area 2 is formed by embedding an insulating film into a groove (trench) that is 0.1 μm to 0.5 μm in width and 3 μm to 7 μm in depth. An area where the emitter address electrode 3 is formed is electrically insulated from the element isolating areas 2 by the trenches.

After the element isolating areas 2 are formed, an impurity such as phosphorus and arsenic is introduced to the surface of the substrate 1, that is, an interior surrounded by the trenches, so that an N-type conductive layer is formed on the substrate 1. The N-type conductive layer between the element isolating areas 2 acts as the emitter address electrode 3.

On the surface of the emitter address electrode 3, emitters 3*a* are formed as electron sources. The emitters 3*a* are arranged to constitute a matrix. In a location opposed to the emitter address electrode 3, a gate electrode 5 is disposed via a gate insulating film 4. The gate electrode 5 includes openings 5*d* opposed to the respective emitters 3*a*. The gate insulating film 4 is removed in the openings 5*d* of the gate electrode 5 and around the emitters 3*a*.

A gate signal wire 8*a* for applying a predetermined potential to the gate electrode 5 is formed orthogonally to the emitter address electrode 3. The gate signal wire 8*a* is formed on an interlayer insulating film 6 on the gate electrode such that the gate electrodes of the electron source elements are not electrically connected to each other. The gate signal wire 8*a* is connected to the gate electrode 5 via a contact hole 7*a*. In order to prevent conductive particles or the like from causing an electrical short circuit between the gate electrode 5 and the gate signal wire 8*a*, an area outside the openings 5*d* of the gate electrode 5 is covered with an insulating protective film 9.

The electron source elements configured thus are arranged in a matrix, achieving a matrix-type cold-cathode electron source device.

The gate electrode 5 is divided into a gate address electrode 5*a* acting as a joint to the gate signal wire 8*a*, a high-resistance gate electrode 5*b* having a high resistance as a high-resistance area, and an emitter area gate electrode 5*c* including the openings 5*d* opposed to the respective emitters 3*a*.

As shown in FIGS. 1A to 1C, the gate address electrode 5*a* is electrically connected in series with the emitter area gate electrode 5*c* via the high-resistance gate electrode 5*b*. In order to suppress a resistance value with a small wiring width, the gate signal wire 8*a* is desirably made of a low-resistance metal or alloy that is mainly composed of Al, Ag, and Cu. The gate electrode 5 is preferably formed of a polysilicon film in view of ease of micromachining and resistance value control. In the gate address electrode 5*a* and the emitter area gate electrode 5*c*, a resistance is preferably reduced by introducing a high concentration of N-type impurity into the polysilicon film. In the fabrication of the high-resistance gate electrode 5*b*, a high-resistance area can be electrically realized by avoiding the introduction of an impurity into the same polysilicon film or reducing the amount of introduced impurity.

In the present embodiment, the high-resistance area had a resistance value of 50 kΩ to 10 MΩ. A resistance value of about 50 kΩ can be easily obtained by a typical ion implantation process with a low concentration. Further, it is known that a polysilicon electrode has a resistance of about 10 MΩ when ion implantation is not performed. In the event of a short circuit between the gate and the emitter during an emission operation, the potential of the emitter area gate electrode 5*c* drops to the potential of the emitter address electrode 3 through the high-resistance gate electrode 5*b*. In this case, the gate address electrode 5*a* and the emitter area gate electrode 5*c* are normally set at low resistance values of about several ohms and thus most of potential drop components caused by a short-circuit current are applied to the high-resistance gate electrode 5*b*, so that the potentials of the gate address electrode 5*a* and the emitter area gate electrode 5*c* can be kept.

As has been discussed, in the configuration of the present invention, the high-resistance gate electrode 5*b* serving as a high-resistance area is provided between the emitter area gate electrode 5*c* and the gate signal wire 8*a*. Thus even when a short circuit occurs between the gate and the emitter, a voltage drop does not occur on the gate signal wire. For this reason, other electron source elements connected to the gate signal wire 8*a* are not subjected to a voltage drop, preventing a line defect.

In the present embodiment, the gate electrode of the emitter area gate electrode 5*c* is formed of the low-resistance polysilicon film, so that quite uniform field distribution is obtained when a voltage is applied to the emitter area gate electrode 5*c*. Therefore, when the emitters 3*a* are not greatly varied in shape, each of the emitters has a highly uniform field intensity, so that a load is not applied to specific one of the emitters and the electron source element is obtained with high reliability.

The resistance of the high-resistance gate electrode 5*b* can be properly determined by a known technique depending upon a required emission current of the electron source element, the number of arranged electron source elements, the drive capability of a driver for supplying a signal, and so on. Moreover, the resistance value of the high-resistance gate electrode 5*b* may be controlled by known techniques, for example, ion implantation and a heat treatment technique that are used in a semiconductor process.

(Second Embodiment)

Figure 2A:
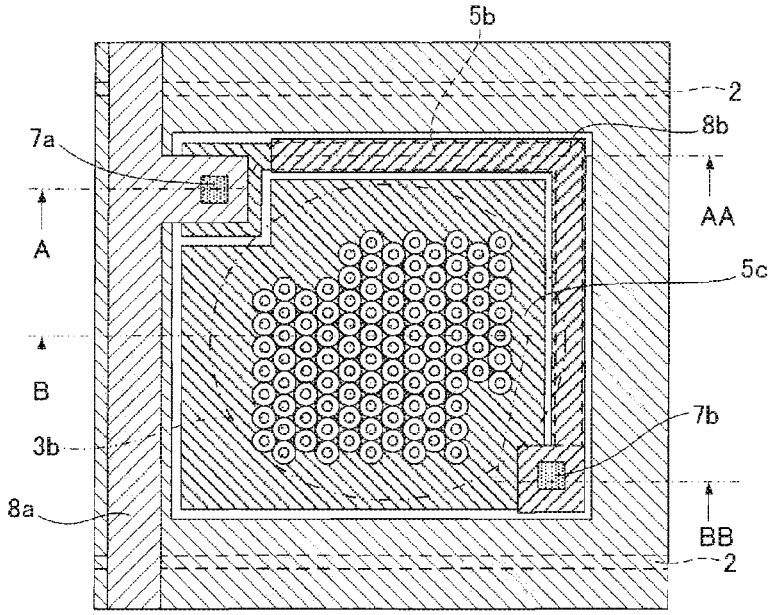
FIG. 2A is a plan view showing the configuration of a cold-cathode electron source element according to a second embodiment of the present invention.
Figure 2B:
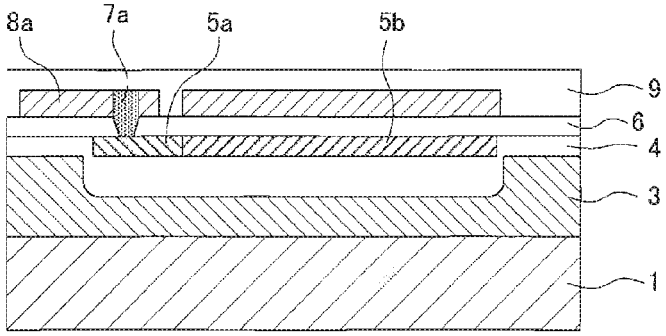
FIG. 2B is a schematic diagram showing a cross section taken along line A-AA according to the second embodiment.
Figure 2C:
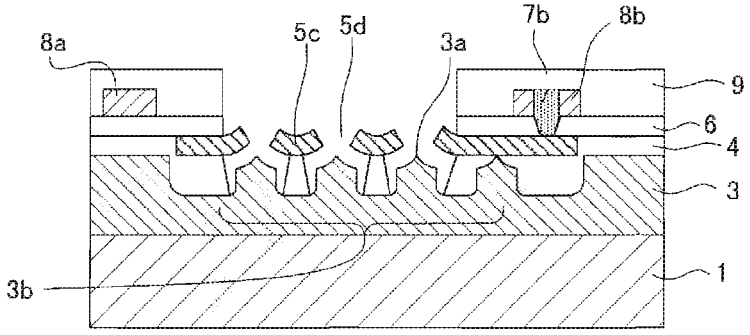
FIG. 2C is a schematic diagram showing a cross section taken along line B-BB according to the second embodiment.
Figure 3:
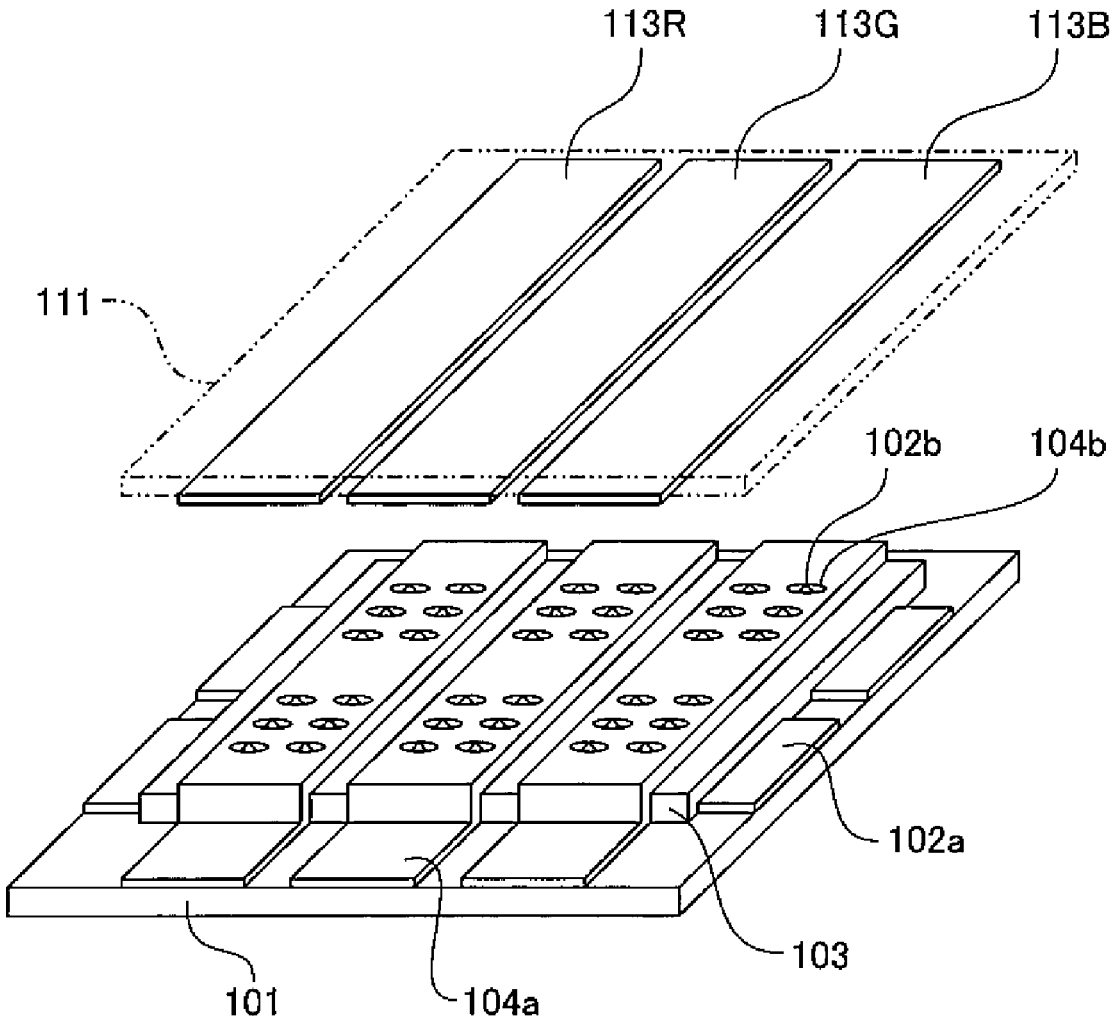
FIG. 3 PRIOR ART
FIG. 3 is a schematic diagram for explaining the configuration of an FED according to the related art.

FIGS. 2A, 2B, and 2C are a plan view and cross-sectional schematic views showing the configuration of a cold-cathode electron source element constituting a cold-cathode electron source device according to a second embodiment of the present invention. In FIGS. 2A, 2B, and 2C, the same parts as those of the first embodiment are indicated by the same reference numerals. The second embodiment is different from the first embodiment in that a shield electrode 8*b* is formed on a high-resistance gate electrode 5*b* via an interlayer insulating film 6.

As shown in FIG. 2, the shield electrode 8*b* is electrically connected to an emitter area gate electrode 5*c* of the gate electrode via a contact hole 7*b*. Further, the shield electrode 8*b* is disposed over the high-resistance gate electrode 5*b*. Moreover, the shield electrode 8*b* may be made of the same material as a gate signal wire 8*a*. Thus the shield electrode 8*b* can be formed concurrently with the formation of the gate signal wire 8*a*. The shield electrode 8*b* disposed on the high-resistance gate electrode 5*b* can achieve the following effects:

First, it is possible to prevent the storage of charge on the high-resistance gate electrode 5*b* and suppress fluctuations in the potential of the high-resistance gate electrode 5*b* during driving, thereby improving the stability and reliability of emission current. The following will specifically describe the mechanism.

Generally, most electrons emitted from emitters 3*a* through field emission fly to an anode surface opposed to the emitters 3*a*. However, about several percents of the emitted electrons return to the electron source element without reaching the anode surface. Some of the returned electrons are attached to the surface of the interlayer insulating film 6 of the electron source element and electrically charge the interlayer insulating film 6. Since the high-resistance gate electrode 5*b* is formed of a polysilicon film, the charged interlayer insulating film 6 affects and changes the potential of the high-resistance gate electrode 5*b*. The amount of charge of the interlayer insulating film 6 fluctuates with an electron content from the emitters 3*a* and time, and thus the potential of the high-resistance gate electrode 5*b* irregularly changes, accordingly.

Consequently, the potential of the emitter area gate electrode 5*c* becomes unstable, so that emission from the emitters 3*a* also becomes unstable. In the present embodiment, this phenomenon can be prevented because the shield electrode 8*b* is formed on the interlayer insulating film 6 provided on the high-resistance gate electrode 5*b*, and the shield electrode 8*b* is electrically connected to the emitter area gate electrode 5*c* of the gate electrode. In other words, charge storage on the interlayer insulating film 6 can be removed by the shield electrode 8*b*, so that the potential of the high-resistance gate electrode 5*b* does not fluctuate and stable emission can be achieved.

Second, the formation of the shield electrode 8*b* effectively increases the resistance value of the high-resistance gate electrode 5*b*. A predetermined voltage is applied to the emitter area gate electrode 5*c* of a gate electrode 5 through the gate signal wire 8*a*. The potential of the emitter area gate electrode 5*c* at this point is also applied to the shield electrode 8*b*. At this time, the high-resistance gate electrode 5*b*, which is formed of a polysilicon film containing an extremely low concentration of impurity, a gate address electrode 5*a*, the emitter area gate electrode 5*c*, the interlayer insulating film 6, and the shield electrode 8*b* are configured like a MOS transistor, and the high-resistance gate electrode 5*b* is inverted.

Consequently, the resistance of the high-resistance gate electrode 5*b* regarded as a series resistor increases and the current reduction capability improves. According to simulation results obtained by changing an actual device size and an impurity concentration, it was found that the current reduction effect can be increased by about two to hundred times when the effect is converted to a resistance value. The second effect can be produced when the high-resistance gate electrode 5*b* of the gate electrode 5 is made of a semiconductor material. Therefore, the requirements of the present invention can be satisfied as long as the gate electrode 5 is made of a material having semiconductor properties.

INDUSTRIAL APPLICABILITY

According to the present invention, an anode plate including phosphor films corresponding to RGB is opposed to an electron source device, so that the function of an FED can be obtained. Further, by providing a photoelectric conversion film as an anode plate, an electron source element can be used as an image element.

The invention claimed is:

1. A matrix-type cold-cathode electron source device comprising:

an emitter array that is formed on an emitter address electrode and contains a plurality of emitters for emitting electrons; and a gate electrode opposed to the emitter array, wherein the gate electrode comprises:

an emitter area gate electrode opposed to the emitter array;

a gate address electrode connecting the emitter area gate electrode to a gate signal wire; and a high-resistance area disposed between the gate address electrode and the emitter area gate electrode, and the matrix-type cold-cathode electron source device further comprises a shield electrode on the gate electrode via an insulating layer, the shield electrode being connected to the emitter area gate electrode.

2. The matrix-type cold-cathode electron source device according to claim 1, wherein the shield electrode is disposed over the high-resistance area.

3. The matrix-type cold-cathode electron source device according to claim 1, wherein the shield electrode is made of a same material as the gate electrode.

4. The matrix-type cold-cathode electron source device according to claim 1, wherein an area other than the high-resistance area of the gate electrode includes a polysilicon film containing a high concentration of N-type impurity, and the high-resistance area includes one of a polysilicon film containing no impurities and a polysilicon film containing a low concentration of impurity.

5. The matrix-type cold-cathode electron source device according to claim 1, wherein the high-resistance area has a resistance value of 50 kΩ to 10 MΩ.

* * * * *